US006079423A

United States Patent [19]

Suzuki

[11] Patent Number: 6,079,423

[45] Date of Patent: Jun. 27, 2000

[54] MAKEUP APPLICATOR AND METHOD OF PRODUCING THE SAME

[75] Inventor: Akio Suzuki, Tokyo, Japan

[73] Assignee: Tokyo Puff Co., Ltd., Tokyo, Japan

[21] Appl. No.: 09/371,787

[22] Filed: Aug. 10, 1999

[30] Foreign Application Priority Data

Feb. 5, 1999 [JP] Japan ..... 11-028827

[51] Int. Cl.[7] ..... A45D 40/26; A45D 40/24; A47K 7/02

[52] U.S. Cl. ..... 132/320; 132/317; 132/318; 15/244.1; 15/209.1

[58] Field of Search ..... 132/320, 317, 132/318; 604/1, 2, 3; 606/162, 163; 15/244.1, 209.1; 300/21

[56] References Cited

U.S. PATENT DOCUMENTS

| | | | |
|---|---|---|---|
| D. 273,238 | 3/1984 | Taylor et al. | D7/102 |
| D. 336,955 | 6/1993 | Hadaway | D24/100 |
| 2,491,274 | 12/1949 | McNeill | 606/162 |
| 2,510,490 | 6/1950 | Ager | 604/1 |
| 3,951,460 | 4/1976 | Blankschein | 15/244 |
| 4,401,130 | 8/1983 | Halford et al. | 132/320 |
| 4,767,398 | 8/1988 | Blasius | 604/1 |
| 4,856,136 | 8/1989 | Janssen | 15/244.3 |
| 4,887,994 | 12/1989 | Bedford | 604/1 |
| 4,913,682 | 4/1990 | Shabo | 604/1 |
| 5,158,532 | 10/1992 | Peng et al. | 604/1 |
| 5,358,480 | 10/1994 | Melcher et al. | 604/1 |
| 5,447,684 | 9/1995 | Williams | 422/20 |
| 5,855,214 | 1/1999 | Heneghan | 132/320 |
| 5,991,960 | 11/1999 | Johnson | 15/210.1 |

*Primary Examiner*—John J. Wilson
*Assistant Examiner*—Robyn Kieu Doan
*Attorney, Agent, or Firm*—Armstrong, Westerman, Hattori, McLeland & Naughton

[57] ABSTRACT

A binding yarn is wound at a portion on the inner periphery of an applicator pad adhered to a stick corresponding to a cutaway groove, where the applicator pad is bound to the core portion of the stick while being bitten into the cutaway groove. Then, a heating head is applied to a certain portion of the binding yarn wound around the applicator pad, to heat it at a predetermined temperature and fuse it. Thereafter, the binding yarn delivered from the tip of a rotary arm is heated and cut to be separated therefrom. The makeup applicator is thus accomplished. Therefore, the present invention provides such a makeup applicator and a method of producing the same, which ensures that the applicator pad is attached to the stick, with a resistance of a long-term use, and with an enhanced sanitary capability and high safety.

10 Claims, 3 Drawing Sheets

MAKEUP APPLICATOR AND METHOD OF PRODUCING THE SAME

BACKGROUND OF THE INVENTION

1. Field of the Invention

The present invention relates to a makeup applicator used for applying cosmetics to a user's skin and a method of producing such a makeup applicator.

2. Description of the Related Art

As a makeup applicator used for applying cosmetics to a user's skin, including an eye-shadow applicator, is known a makeup applicator formed of a stick serving as a holder to be held by a user in use and an applicator pad attached to either end or both ends of the stick.

A conventional method of producing such a makeup applicator formed of a stick and an applicator pad comprises the steps of: individually producing a stick and a flat bag-like applicator pad having an opening; applying adhesive to a portion of the stick to which the applicator pad is to be attached; and inserting either end of the stick into the bag-like applicator pad to be thereby fixedly connected to each other. A production of the makeup applicator is consequently accomplished. It is noted that in this production process, the step of inserting the end of the stick into the applicator pad is performed manually in common.

In another production method, after adhesive is applied to a stick, a pair of applicator pad materials facing each other sandwiching the stick therebetween is cut into a predetermined shape and solvent welded through, for example, a ultrasonic welding, resulting in mounting the applicator pad to the stick.

As such, any makeup applicator produced by these conventional methods is so arranged that adhesive is used to attach the applicator pad to the stick. Therefore, adhesion of the applicator pad to the stick will be lower, with tendency of releasing the applicator pad from the stick in use due to the deterioration as time elapses, providing no resistance for a long-term use. These problems arise with such conventional makeup applicators.

Further, for instance, the applicator pad impregnated with the cosmetics may permit the adhesive to be concurrently exited. The adhesive may be then applied together with the cosmetics to a user's eye area, lips or the like beyond the user's attention, which will be danger. Accordingly, there also exists a drawback for safety.

The present invention has been therefore made and an object of the present invention is to provide a makeup applicator and a method of producing the same, which ensures that an applicator pad is attached to a stick, with a resistance for a long-term use, and with high safety and an enhanced sanitary capability.

SUMMARY OF THE INVENTION

In order to solve the foregoing problems, according to a first aspect of the present invention, a makeup applicator comprising a bag-like applicator pad used for applying cosmetics with its surface, and a stick to which said applicator pad is attached, is characterized in that said stick has a core portion inserted into said applicator pad, and a cutaway portion formed at a position on said core portion so as to contact the inner periphery of the end edge portion on the open side of said applicator pad, and said applicator pad is fixed to said stick such that said applicator pad is bound to said core portion by a binding yarn with being bitten into said cutaway portion while the inner periphery contacts said cutaway portion.

In order to solve the foregoing problems, according to a second aspect of the present invention, the makeup applicator is characterized in that the binding yarn is made of a synthetic polymeric material having thermoplastic property, said binding yarn being secured by heat fusing predetermined portions thereof.

In order to solve the foregoing problems, according to a third aspect of the present invention, the makeup applicator is characterized in that the binding yarn is a yarn containing rubber.

In order to solve the foregoing problems, according to a fourth aspect of the present invention, the makeup applicator is characterized in that the binding yarn is wound for at least five turns around the outer periphery of the end edge portion on the open side of said applicator pad along the circumferential path substantially orthogonal to the axis of said stick.

In order to solve the foregoing problems, according to a fifth aspect of the present invention, the makeup applicator is characterized in that the binding yarn has substantially the same color as that of said applicator pad.

In order to solve the foregoing problems, according to a sixth aspect of the present invention, a method of producing a makeup applicator having a stick capped with a bag-like applicator pad used for applying cosmetics with its surface, is characterized by comprising:

preparing a member to be adhered in which the applicator pad is adhered onto the stick, said stick being formed with a cutaway portion at a predetermined portion at the tip, so that a predetermined portion on the end edge portion on the open side of said applicator pad may correspondingly be positioned at the cutaway portion;

winding a binding yarn for predetermined turns around the applicator pad while the inner periphery contacts the cutaway portion so that a certain binding force may occur; and binding and fixing the applicator pad to the stick.

In order to solve the foregoing problems, according to a seventh aspect of the present invention, the method of producing a makeup applicator is characterized in that the binding yarn made of a synthetic polymeric material having thermoplastic property is wound around the applicator pad for predetermined turns, and including heating the binding yarn at predetermined portions, and fusing the predetermined portions of the binding yarn to be secured.

In order to solve the foregoing problems, according to a eighth aspect of the present invention, the method of producing a makeup applicator is characterized by further including after heat fusing the predetermined portions of the binding yarn, heating a predetermined portion of the binding yarn, and cut off the portion of the binding yarn not wound around the applicator pad from the portion thereof wound around the applicator pad.

In order to solve the foregoing problems, according to a ninth aspect of the present invention, the method of producing a makeup applicator is characterized in that the binding yarn is wound for at least five turns around the outer periphery of the end edge portion on the open side of the applicator pad along the circumferential path substantially orthogonal to the axis of the stick.

In order to solve the foregoing problems, according to a tenth aspect of the present invention, the method of producing a makeup applicator is characterized in that said member to be adhered in which the applicator pad is adhered onto the stick is prepared in advance, said applicator pad being formed as to be narrower and relatively thinner at the end edge portion on the open side around which the binding yarn is to be wound.

BRIEF DESCRIPTION OF THE DRAWINGS

These and other objects, advantages, and features of the present invention will become apparent during the following discussion in conjunction with the accompanying drawings, wherein.

DESCRIPTION OF THE PREFERRED EMBODIMENTS

Preferred embodiments of the present invention will now be described in detail with reference to the accompanying drawings.

First Embodiment

Figure 1:
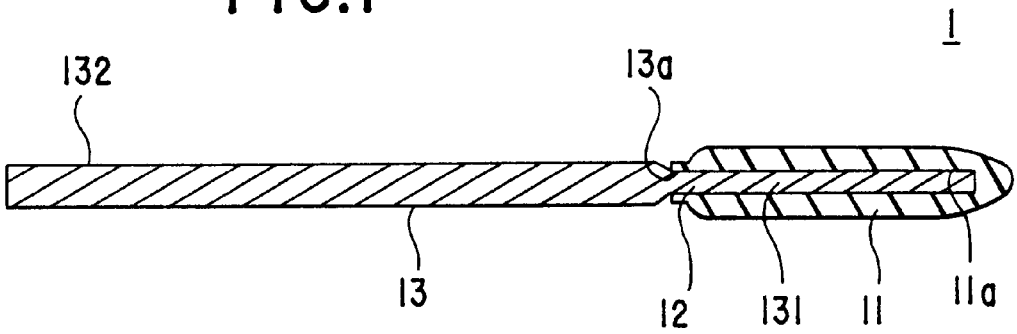
FIG. 1 is a sectional view showing a structure of a makeup applicator in accordance with a first embodiment of the present invention.
Figure 2:
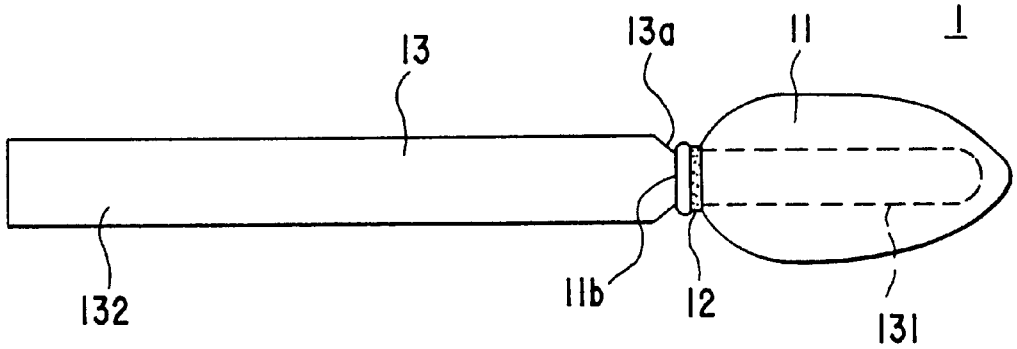
FIG. 2 is a top plan view showing the structure of the makeup applicator shown in FIG. 1.

FIG. 1 is a sectional view showing a structure of a makeup applicator in accordance with a first embodiment of the present invention, FIG. 2 is a top plan view showing the structure of the makeup applicator, and FIGS. 3*a* to 3*e* are diagrams showing steps for describing a method of producing the makeup applicator.

Referring now to FIGS. 1 and 2, a makeup applicator 1 according to a first embodiment of the present invention comprises an applicator pad 11 to be impregnated with cosmetics to apply these, and a stick 13 having a tip side core portion 131 to which the applicator pad 11 is attached through binding yarn 12.

The applicator pad 11 is made of foam such as foamed polyurethane and foamed rubber, non-woven, or woven fabric. Further, the applicator pad 11 is shaped into a bag having a hollow portion 11*a* into which the tip side core portion 131 of the stick 13 is inserted, as will be described later.

The binding yarn 12 is made of thermoplastic chemical fiber such as nylon or polyethylene, which is fused at a predetermined temperature, to be thereby fixed in the vicinity of an opening portion 11*b* of the applicator pad 11. The binding yarn 12 is selectively implemented in relatively thinner yarn (e.g., yarn having yarn number 120) whose color having the same tone as the applicator pad 11 is favorably used.

The stick 13 fitted into the hollow portion 11*a* of the applicator pad 11 comprises a thin core portion 131 also serving as the core of the applicator pad 11, and a holder portion 132 to be held by a user in use. The stick 13 is scribed with a cutaway groove 13*a* having a V shape in section at a place where the opening portion 11*b* of the applicator pad 11 is positioned in the vicinity of the interface with the holder portion 132 of the core portion 131. The cutaway groove 13*a* extends along the circumferential path on the outer periphery which is substantially orthogonal to the axis of the stick 13. The binding yarn 12 is wound around the applicator pad 11 at the portion on the inner peripheral surface of the applicator 11 corresponding to the cutaway groove 13*a*, resulting in binding the applicator pad 11 to the stick 13.

The applicator pad 11 is robustly secured to the stick 13 by being bound through the binding yarn 12 while being bitten into the cutaway groove 13*a*.

The stick 13 is made of thermoplastic synthetic resin such as polypropylene, polyethylene, polyvinyl chloride, or polyester, which is formed through injection molding or the like.

A description will now be made of a method of producing the makeup applicator 1.

Figure 3A:
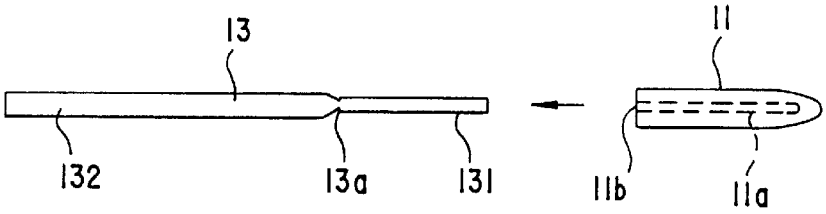
FIGS. 3*a* to 3*e* are diagrams showing steps for describing a method of producing the makeup applicator of FIG. 1.
Figure 3B:
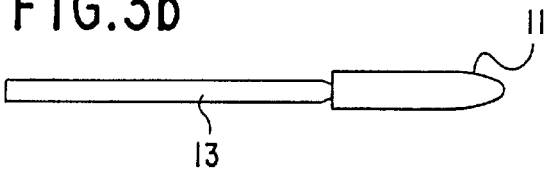

Referring to FIG. 3*a*, first, the hollow portion 11*a* is prepared in the applicator pad 11 by means of, for example, an ultrasonic welder or the like. Then, the core portion 131 of the stick 13 is fitted into the thus prepared hollow portion 11*a*. In FIG. 3*b*, the stick 13 capped with the applicator pad 11 is thus obtained. At this stage, the applicator pad 11 merely caps the core portion 131 of the stick 13 without any adhesive.

Figure 3C:
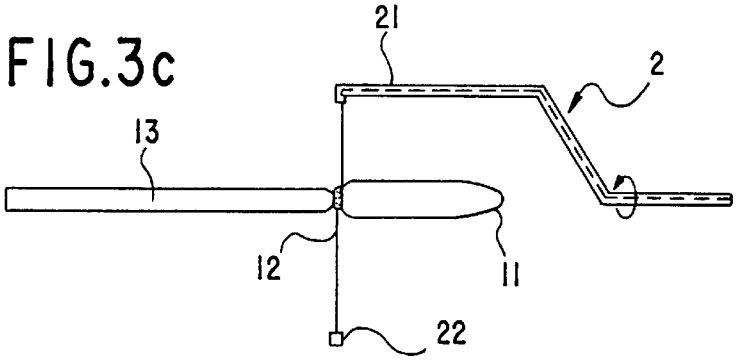

Thereafter, as shown in FIG. 3*c*, a yarn winding device 2 is used to wind the binding yarn 12 around the applicator pad 11. Specifically, while either end of the binding yarn 12 is fixed by a fixing unit 22, a rotary arm 21 is rotated. This allows the binding yarn 12 to be wound around and bound to the applicator pad 11. The applicator pad 11 is thus secured to the stick 13.

The binding yarn 12 is now wound at a portion on the inner periphery of the applicator pad 11 corresponding to the cutaway groove 13*a*, where the applicator pad 11 is bound to the core portion 131 with the binding yarn 12 being bitten into the cutaway groove 13*a*.

Figure 3D:
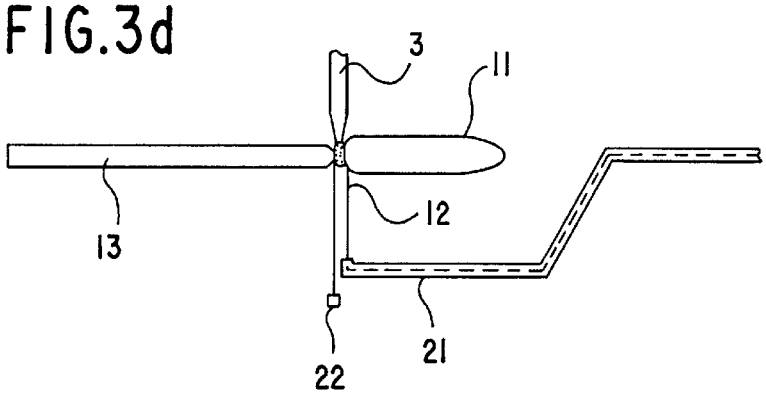
Figure 3E:
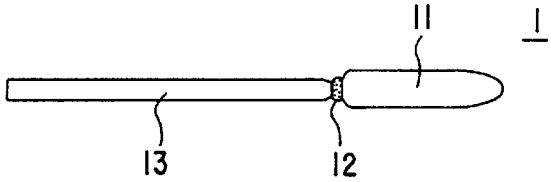

Then, after a five-turn winding, for example, as shown in FIG. 3*d*, a heating head 3 is applied to a certain portion of the binding yarn 12 wound around the applicator pad 11, to heat it at a predetermined temperature and fuse it. Thereafter, the binding yarn 12 that is delivered from the tip of the rotary arm 21 is heated and cut to be separated therefrom. Then, the makeup applicator 1 shown in FIG. 3*e* can be obtained.

For use of the makeup applicator 1, if an external force is exerted upon the applicator pad 11 along the axis of the stick 13 so as to separate the applicator pad 11 therefrom, the applicator pad 11 maintains the attached state against the external force. Because the applicator pad 11 is fixed to the stick 13 with deformed along and bitten into the cutaway groove 13*a*.

As described above, according to the first embodiment of the present invention, the applicator pad 11 is attached to the stick 13 by means of the binding yarn 12. This assures that the applicator pad 11 may be fixed, making it possible to bear a long-term use.

In addition, the cutaway groove 13*a* is formed in a predetermined position on the core portion 131 of the stick 13. The binding yarn 12 is wound around the portion where the inner periphery of the applicator pad 11 encounters the cutaway groove 13*a*, where the applicator pad 11 is bound and positively secured to the core portion 131 while being bitten into the cutaway groove 13*a*. Such a mounting structure can be attained that the applicator pad 11 upon which an external force is exerted is hardly separated therefrom, allowing more increased resistance to bear against a long-term and multiple frequent use.

The binding yarn 12 wound around at a place of the cutaway groove 13*a*, and this enables the binding yarn 12 to be less notably appeared.

Since no adhesive, for example, is used for mounting the applicator pad 11, it will be sanitary and enhanced in safety.

Further, the color of the binding yarn 12 is substantially the same as that of the applicator pad 11, and therefore the binding yarn 12 will be less noticeable, allowing for maintenance of beauties.

Still further, the binding yarn 12 is fixed by heat fusing these predetermined portions to each other which maintain a certain binding force and are hardly released each other. This assures that the applicator pad 11 can be robustly fixed to the stick 13. Further, such a fixing operation may be carried out only by heating the predetermined portions, and therefore a simple fixing operation of the binding yarn 12 can be attained in a short time.

Furthermore, the binding yarn 12 is heated at the predetermined position to cut off the portion of the applicator pad 11 around which the binding yarn 12 is wound from the portion thereof otherwise. This assures that the binding yarn 12 can be easily cut off.

The binding yarn 12 can be positively fixed to the outer periphery of the end edge portion on the open side of the applicator pad 11 along the circumferential path orthogonal to the axis of the stick 13 after a five-turn winding, for example. Therefore, the makeup applicator 1 can be efficiently produced at low cost without excessive use of the binding yarn 12.

Second Embodiment

Figure 4A:
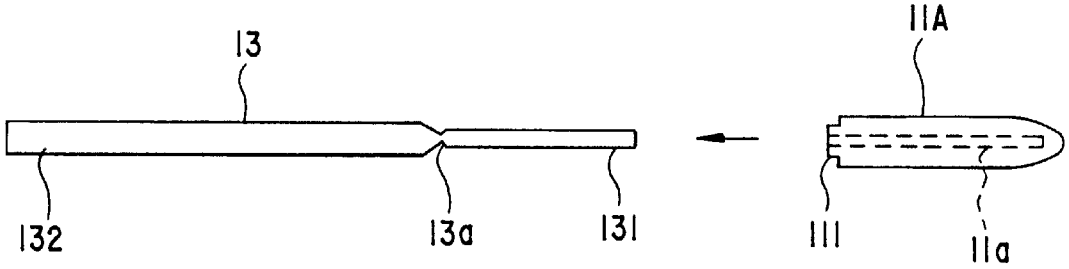
FIGS. 4*a* and 4*b* are diagrams showing steps for describing a method of producing a makeup applicator in accordance with a second embodiment of the present invention.
Figure 4B:
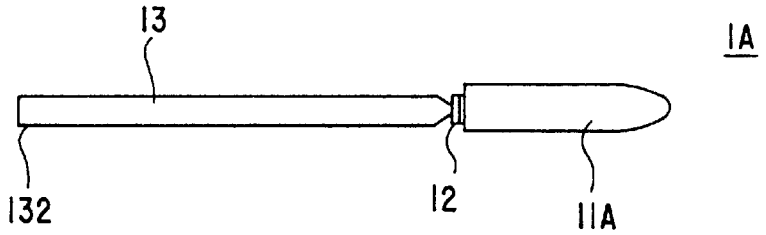

FIGS. 4*a* and 4*b* are diagrams showing steps for describing a method of producing a makeup applicator in accordance with a second embodiment of the present invention.

The structure of the second embodiment of the present invention is substantially the same as that of the first embodiment, except for an alternative applicator pad 11A that is prepared in advance. Referring to FIG. 4*a*, the alternative applicator pad 11A is formed to be narrower and relatively thinner at the end edge portion on the open side around which the binding yarn 12 is to be wound.

To produce a makeup applicator 1A according to the second embodiment, first, as shown in FIG. 4*a*, a stick 13 capped with the applicator pad 11A is prepared in advance.

In this figure, the applicator pad 11A has a narrower and relatively thinner wound portion 111 at the end edge portion on the open side around which the binding yarn 12 is to be wound.

Thereafter, the binding yarn 12 is wound around the applicator pad 11A in a similar way to the first embodiment. The binding yarn 12 is then heat fused, and heated and cut to accomplish the makeup applicator 1A shown in FIG. 4*b*.

As described above, according to the second embodiment of the present invention, the applicator pad 11A prepared in advance is made narrower and relatively thinner at the end edge portion on the open side around which the binding yarn 12 is to be wound. With such an arrangement, a relative low binding force with which the applicator pad 11A is bound to the stick 13 by the binding yarn 12 will allow the applicator pad 11A to be securely and robustly fixed to the stick 13 because a reactive force from the material of the applicator pad 11A is also relatively low, as an example. In addition, the beautiful appearance may not be failed due to an expanded end portion of the applicator pad 11A, for instance.

Although the preferred embodiments of the present invention have been described in detail, a specific structure thereof is not to be limited to these embodiments.

For example, in the first embodiment described above, the color of the binding yarn 12 is substantially the same as that of the applicator pad 11; however, the same color is not necessarily required. Alternatively, a binding yarn containing rubber may be used to enhance a binding force of the binding yarn.

Although the stick 13 manufactured by injection molding has been described, additional cutting and heat compression processes may be applied thereto after extrusion.

Moreover, the cutaway groove 13*a* may not be necessarily be formed across the periphery of the stick 13. Additionally, the section of the cutaway groove 13*a* is not limited to a V shape, but a U shape or a rectangular shape may also be adopted.

Application pads may also be placed at the both ends of the stick.

As has been described in the foregoing section, according to the first aspect of the present invention, the applicator pad is attached to the stick by means of the binding yarn. This assures that the applicator pad may be fixed, making it possible to bear a long-term use.

In addition, the cutaway groove is formed in a predetermined position on the core portion of the stick. The binding yarn is wound around the portion where the inner periphery of the applicator pad encounters the cutaway groove, where the applicator pad is bound and positively secured to the core portion while being bitten into the cutaway groove. Such a mounting structure can be attained that the applicator pad upon which an external force is exerted is hardly separated therefrom, allowing more increased resistance to bear against a long-term and multiple frequent use.

The binding yarn is wound around at a place of the cutaway groove, and this enables the binding yarn to be less notably appeared.

Since no adhesive, for example, is used for securing the applicator pad to the stick, it will be sanitary and enhanced in safety.

Further, according to the second aspect of the present invention, the binding yarn is fixed by heat fusing predetermined portions to each other which maintain a certain binding force and are hardly released each other. This assures that the applicator pad can be robustly fixed to the stick.

Further, according to the third aspect of the present invention, the binding yarn contains rubber, and this more increasingly assures that the applicator pad can be bound and fixed to the stick.

Further, according to the fourth aspect of the present invention, the binding yarn is wound for at least five turns around the outer periphery of the end edge portion on the open side of the applicator pad along the circumferential path substantially orthogonal to the axis of the stick. This assures the fixing operation, without an excessive need for the binding yarn.

Further, according to the fifth aspect of the present invention, the color of the binding yarn is substantially the same as that of the applicator pad, and therefore the binding yarn will be less noticeable, allowing for maintenance of beauties.

Further, according the sixth aspect of the present invention, the stick formed with the cutaway groove in a predetermined position at the tip is used. The binding yarn is wound around the portion where the inner periphery of the applicator pad encounters the cutaway groove, where the applicator pad is bound and positively secured to the core portion while being bitten into the cutaway groove. Such a mounting structure can be attained that the applicator pad upon which an external force is exerted is hardly separated therefrom, allowing a more increased resistance to bear against a long-term and multiple frequent use.

The binding yarn wound around at a place of the cutaway groove, and this enables the binding yarn to be less notably appeared.

Since no adhesive, for example, is used for mounting the applicator pad, it will be sanitary and enhanced in safety.

Further, according to the seventh aspect of the present invention, the binding yarn is fixed by heat fusing predetermined portions to each other which maintain a certain binding force and are hardly released each other. This assures that the applicator pad can be robustly fixed to the stick. Moreover, the fixing operation may be carried out only by heating the predetermined portions, and hence a simple fixing operation of the binding yarn can be attained in a short time.

Further, according to the eighth aspect of the present invention, a predetermined portion of the binding yarn is heated, and then the portion of the binding yarn not wound around the applicator pad is cut off from the portion thereof wound around the applicator pad. This assures that the binding yarn can be readily cut off.

Further, according to the ninth aspect of the present invention, the binding yarn is wound for at least five turns around the outer periphery of the end edge portion on the open side of the applicator pad along the circumferential path substantially orthogonal to the axis of the stick. This assures the fixing operation, without an excessive need for the binding yarn, enabling an efficient production at low cost.

Further, according to the tenth aspect of the present invention, the member to be adhered is prepared in advance in which the applicator pad is adhered onto the stick, the applicator pad being formed as to be narrower and relatively thinner at the end edge portion on the open side around which the binding yarn is to be wound. With such an arrangement, a relative low binding force with which the applicator pad is bound to the stick by the binding yarn will allow the applicator pad to be securely and robustly fixed to the stick. In addition, the beautiful appearance may not be failed due to an expansible end portion of the applicator pad, for instance.

While the present invention has been described with reference to specific embodiments, it will be apparent that other alternative embodiments and methods of implementation or modification may be employed without departing from the spirit and scope of the invention.

What is claimed is:

1. A makeup applicator comprising a bag-like applicator pad used for applying cosmetics with its surface, and a stick to which said applicator pad is attached, wherein:

said stick includes a core portion to be inserted into inside of said applicator pad, and a cutaway portion formed at a prescribed position on said core portion so as to encounter the inner periphery of an end edge portion on the open side of said applicator pad, and said applicator pad is fixed to said stick such that said applicator pad is bound to said core portion by a binding yarn while being bitten into said cutaway portion while the inner periphery encounters said cutaway portion.

2. A makeup applicator as claimed in claim 1, wherein the binding yarn is made of a synthetic polymeric material having thermoplastic property, said binding yarn being secured by heat fusing predetermined portions thereof.

3. A makeup applicator as claimed in claim 1 or 2, wherein the binding yarn is a yarn containing rubber.

4. A makeup applicator as claimed in claim 1 or 2, wherein the binding yarn is wound for at least five turns around the outer periphery of the end edge portion on the open side of said applicator pad along the circumferential path substantially orthogonal to the axis of said stick.

5. A makeup applicator as claimed in claim 1 or 2, wherein the binding yarn has substantially the same color as that of said applicator pad.

6. A method of producing a makeup applicator having a stick capped with a bag-like applicator pad used for applying cosmetics with its surface, comprising:

preparing a member to be adhered in which the applicator pad is adhered onto the stick, said stick being formed with a cutaway portion at a predetermined portion at the tip, so that a predetermined portion on the end edge portion on the open side of said applicator pad may correspondingly be positioned at the cutaway portion;

winding a binding for yarn predetermined turns around the applicator pad while the inner periphery encounters the cutaway portion so that a certain binding force may occur; and binding and fixing the applicator pad to the stick.

7. A method of producing a makeup applicator as claimed in claim 6, further comprising:

winding the binding yarn made of a synthetic polymeric material having thermoplastic property around the applicator pad for predetermined turns;

heating the binding yarn at predetermined portions; and fusing the predetermined portions of the binding yarn to be secured.

8. A method of producing a makeup applicator as claimed in claim 7, further comprising:

heat fusing the predetermined portions of the binding yarn;

heating a predetermined portion of the binding yarn; and cutting off the portion of the binding yarn not wound around the applicator pad from the portion thereof wound around the applicator pad.

9. A method of producing a makeup applicator as claimed in any one of claims 6 to 8, wherein the binding yarn is wound for at least five turns around the outer periphery of the end edge portion on the open side of the applicator pad along the circumferential path substantially orthogonal to the axis of the stick.

10. A method of producing a makeup applicator as claimed in any one of claims 6 to 9, wherein said member to be adhered in which the applicator pad is adhered onto the stick is prepared in advance, said applicator pad being formed as to be narrower and relatively thinner at the end edge portion on the open side around which the binding yarn is to be wound.

* * * * *